United States Patent [19]

Lenz et al.

[11] Patent Number: 4,693,667

[45] Date of Patent: Sep. 15, 1987

[54] TURBINE INLET NOZZLE WITH COOLING MEANS

[75] Inventors: Herman N. Lenz, Lambertville, Mich.; Allen G. Chen, Sylvania, Ohio

[73] Assignee: Teledyne Industries, Inc., Los Angeles, Calif.

[21] Appl. No.: 390,872

[22] Filed: Jun. 22, 1982

Related U.S. Application Data

[63] Continuation of Ser. No. 144,909, Apr. 29, 1980, abandoned.

[51] Int. Cl.[4] ..... F01D 5/14

[52] U.S. Cl. ..... 415/115; 415/116

[58] Field of Search ..... 415/115, 116

[56] References Cited

U.S. PATENT DOCUMENTS

| | | | |
|---|---|---|---|
| 3,628,880 | 12/1971 | Smuland | 415/115 |
| 4,126,405 | 11/1978 | Bobo et al. | 415/115 |
| 4,278,400 | 7/1981 | Yamarik et al. | 415/115 |
| 4,303,371 | 12/1981 | Eckert | 415/116 |

FOREIGN PATENT DOCUMENTS

| | | | |
|---|---|---|---|
| 1164847 | 9/1969 | United Kingdom | 415/115 |

*Primary Examiner*—Harvey C. Hornsby
*Assistant Examiner*—Frankie L. Stinson
*Attorney, Agent, or Firm*—Gifford, Groh, VanOphem, Sheridan, Sprinkle and Dolgorukov

[57] ABSTRACT

A novel turbine inlet nozzle assembly is provided for use with a gas turbine engine and includes unique nozzle cooling means. The turbine inlet nozzle of the present invention comprises an inner annular shroud, an outer annular shroud coaxial with and spaced radially outwardly from the inner shroud and a plurality of circumferentially spaced vanes extending between the shrouds. The shrouds and the vanes, moreover, are of integral construction with each other and, preferably, each vane has a hollow interior. An annular impingement plate is fixedly secured about each axial end to the outer periphery of the outer shroud while, similarly, a second impingement plate is secured at each axial end to the inner periphery of the inner shroud. Moreover, the impingement plates include a plurality of holes formed therethrough and through which a portion of the turbine compressor output is bled to cool the inner and outer shrouds. These holes are arranged both in density and hole size in accordance with the cooling requirements of the shrouds. An impingement liner is also preferably positioned within each of the nozzle vanes. Excessive thermal stress between the outer shroud and its impingement plate is prevented by forming the outer impingement plate in an S shape in cross section adjacent each axial end of the outer impingement plate.

9 Claims, 5 Drawing Figures

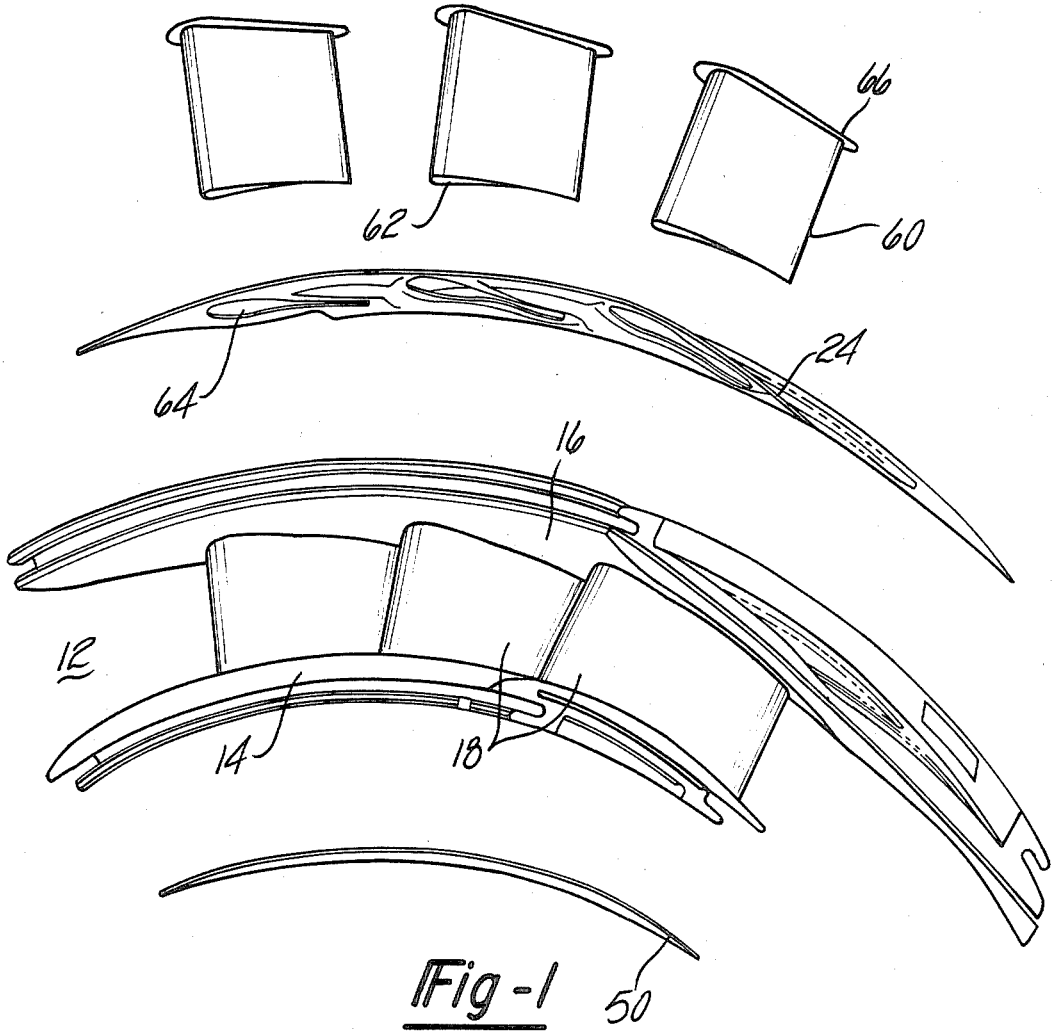
Fig-1
Fig-3
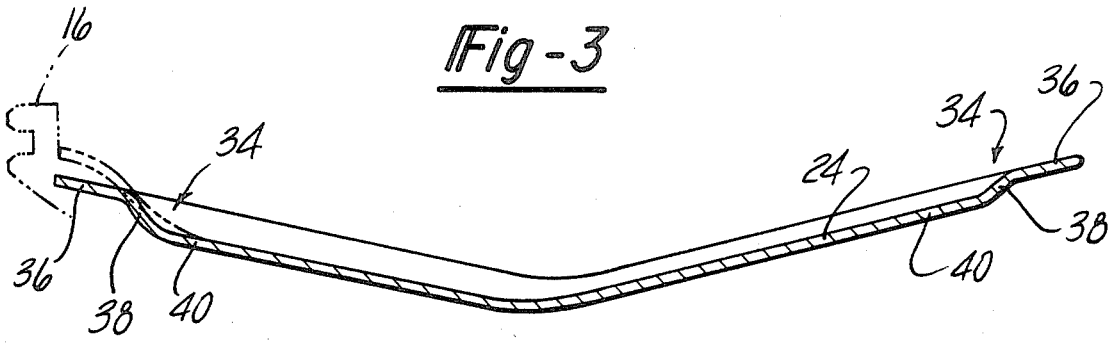

TURBINE INLET NOZZLE WITH COOLING MEANS

CROSS REFERENCE TO RELATED APPLICATIONS

This is a continuation, of application Ser. No. 144,909, filed 4/29/80 now abandoned.

BACKGROUND OF THE INVENTION

I. Field of the Invention

The present invention relates generally to turbine inlet nozzles for gas turbine engines and, more particularly, to such a turbine inlet nozzle with novel cooling means.

II. Description of the Prior Art

The previously known gas turbine engines typically comprise a support housing in which a main shaft is rotatably mounted. A compressor means is operatively secured to the shaft which receives air from an air inlet, compresses the air and supplies its compressed air outlet to a combuster assembly within the support housing. In the combustion assembly, fuel is mixed with the compressed air and ignited and the resulting combustion products from the combustor assembly expand through one or more turbine stages secured to the main shaft to rotatably drive the compressor and also to provide the engine output.

In the previously known designs for turbine engines, a nozzle is disposed in the gas stream passageway between the outlet from the combustor assembly and the first turbine stage. Such nozzles typically comprise a plurality of circumferentially spaced vanes positioned coaxially around the turbine shaft.

The trend in turbine engine design in recent years has been to increase the combustion temperature of the engine since the increase of combustion temperature likewise increases the overall efficiency of the turbine engine. Because of this, the turbine nozzle assemblies are subjected to extremely high temperatures. The materials conventionally used in the construction of the turbine inlet nozzle are incapable of withstanding the high temperature environment from the engine gas stream without excessive and unacceptable thermal distortion and must therefore be cooled during the operation of the turbine engine.

One previously known method of cooling the turbine nozzle assembly during the operation of the turbine engine has been to provide an impingement plate coaxially around the outer shroud of the nozzle assembly. The impingement plate includes a plurality of holes formed through it and is spaced radially outwardly from the outer perhiphery of the outer shroud thus forming a chamber therebetween. A portion of the compressed air outlet from the turbine engine compressor is diverted to the outer side of the impingement plate so that the compressed air flows through the holes in the impingement plate and against the outer shroud thus cooling it. Typically this cooling air flow is subsequently exhausted to the turbine engine gas stream and expelled from the turbine engine. In addition, a number of previously known turbine engines included hollow vanes through which the cooling air flow passed prior to its exhaustion into the turbine engine gas stream.

The use of impingement plates for cooling the turbine nozzle, however, have suffered from a number of disadvantages. One such disadvantage is the impingement plate is normally maintained at a much cooler temperature than the turbine nozzle components due to the cooling air flow through the impingement plate and thus the impingement undergoes differential thermal growth with respect to the other turbine nozzle components. Consequently, it has not been previously possible to secure the impingement plate directly to the shroud due to the high thermal stress and possible rupture between the impingement plate and the other nozzle components.

In order to prevent coolant leakage between the impingement plate and the nozzle components, it has been the previous practice to employ seals between the impingement plate and the nozzle shroud. In practice, however, such seals have proven inadequate thus resulting in high coolant loss, insufficient cooling of the turbine nozzle and degradation in the performance of the turbine engine. When the turbine nozzle is of multi piece construction, i.e. the shrouds and vanes are separately constructed and thereafter secured together, seals are also employed between the turbine nozzle components and these seals likewise result in high coolant leakage.

A still further disadvantage of the previously known turbine nozzles with impingement plate cooling means is the holes through the impingement plate are evenly distributed across it. Such impingement plates thus provide even cooling across the turbine engine nozzle and particularly the outer shroud. Advanced turbine engines, however, operate in an environment with varying gas temperature distribution and surface heating rate of the nozzle components. The varying gas distribution is due primarily to the characteristics of the combustion assembly while variation of the surface heating rate of the nozzle components is controlled primarily by the pressure distribution and flow shape across the nozzle surfaces. The previously known nozzle cooling means utilizing impingement plates have failed to address the varying cooling requirements of the turbine inlet nozzle and thus have failed to evenly cool the nozzle assembly in the desired fashion.

SUMMARY OF THE PRESENT INVENTION

The present invention provides a turbine inlet nozzle with novel cooling means which overcomes all of the abovementioned disadvantages of the previously known turbine nozzle designs.

In brief, the turbine nozzle according to the present invention comprises an inner annular shroud, an outer annular shroud coaxial with and spaced radially outwardly from the inner shroud, and a plurality of circumferentially spaced vanes extending between the shrouds. The shrouds and vanes, moreover, are of a one piece or integral construction thus eliminating any need for sealing between the nozzle components.

A tubular and cylindrical impingement plate is positioned around the outer periphery of the outer shroud so that the impingement plate extends entirely across the turbine nozzle vanes. Each axial end of the impingement plate is fixedly secured to the outer shroud by welding, brazing or the like thus eliminating any possibility of coolant leakage around the edges of the impingement plate. With the impingement plate secured to the outer shroud in this fashion, a chamber or chambers are formed between the impingement plates and the outer shroud and these chambers are fluidly connected to the gas stream passageway by passageways formed through the nozzle assembly.

In order to prevent excessive and unacceptable stresses between the impingement plate and the outer shroud due to differential thermal growth, the outer impingement plate includes an S-shaped portion in cross section adjacent each axial end of the impingement plate. Upon the differential thermal growth of the outer shroud in the impingement plate, the S-shaped portions of the impingement plate merely distort without causing unacceptable thermal stress between the impingement plate and the outer shroud.

A plurality of holes are formed through the outer impingement plate and a portion of the compressed air output from the turbine air compressor is bled to the outer periphery of the impingement plate. This compressed air expands through the holes in the impingement plate, into the chambers between the impingement plate in the outer shroud and against the shroud thus cooling it. This cooling air flow is then exhausted to the turbine engine gas stream through the nozzle passageways. Unlike the previously known impingement plates, however, the impingement plate holes are of a variable density and hole size across the outer impingement plate in accordance with the cooling requirements of nozzle assembly. Thus, for example, a greater density and/or greater hole size is provided in the impingement plate where additional nozzle cooling is required and vice versa.

In the preferred form of the invention, each nozzle is hollow. A vane liner is then positioned within each nozzle vane so that the outer periphery of the liner is spaced radially inwardly from the interior vane walls. Each vane liner is positioned through an opening in the outer impingement plate and the bottom of each vane liner is closed. A plurality of holes are also formed through each vane liner so that compressed air from the turbine compressor flows in through the open top of the liner, through the holes and against the interior walls of the vane thus cooling the vane. This compressed air is then expelled out through ports in the trailing end of each vane and to the gas stream. Like the impingement plate, the holes in the vane liner vary in density and/or hole size in accordance with the cooling needs of the vane.

An inner impingement plate is also secured to the inner periphery of the inner shroud so that a chamber is formed between the inner shroud and the inner impingement plate. Compressed cooling air is supplied to the inner periphery of the inner shroud and this air passes through holes in the inner impingement plate and into the chamber thus cooling the inner shroud. This cooling air flow is subsequently exhausted to the turbine engine gas stream through passageways formed in the nozzle.

Like the outer impingement plate, each axial end of the inner impingement plate is fixedly secured to the nozzle by brazing or other conventional means. Since the differential thermal growth between the inner shroud and the inner impingement plate is relatively small, it is unnecessary to provide the S-shaped portions on the inner impingement plate.

BRIEF DESCRIPTION OF THE DRAWING

A better understanding of the present invention will be had upon reference to the following detailed description, when read in conjunction with the accompanying drawing wherein like reference characters refer to like parts throughout the several views, and in which:

FIG. 1 is a fragmentary exploded view illustrating a turbine nozzle assembly according to the present invention;

FIG. 3 is a sectional view illustrating the outer impingement liner and taken between adjacent nozzle vanes and enlarged for clarity;

DETAILED DESCRIPTION OF A PREFERRED EMBODIMENT OF THE PRESENT INVENTION

Figure 2:
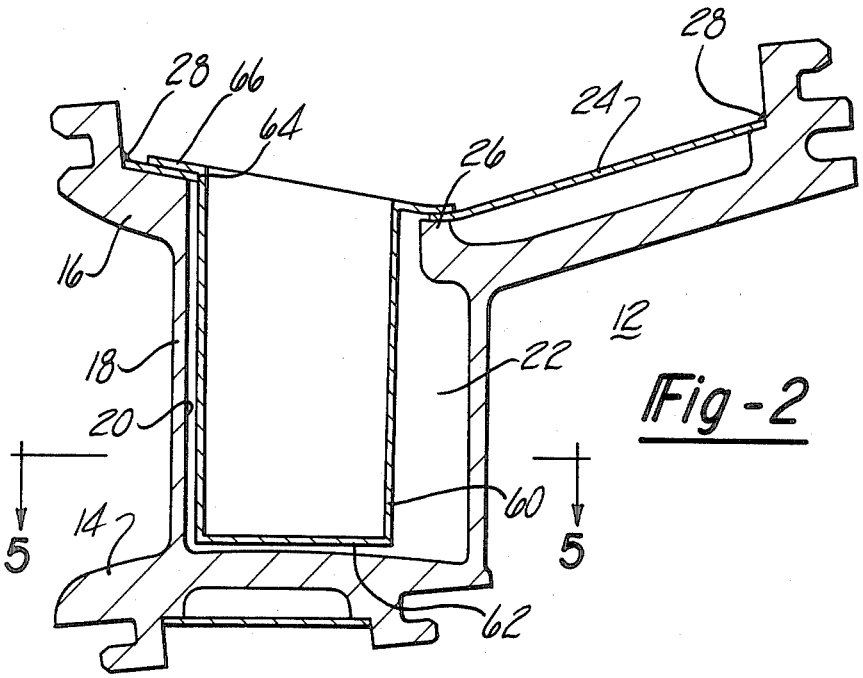
FIG. 2 is a cross-sectional view of the nozzle assembly taken through one of the nozzle vanes.

With reference first to FIG. 1, a preferred embodiment of an turbine inlet nozzle according to the present invention is thereshown for use with a gas turbine engine. The gas turbine engine is not illustrated in the drawing but, in the conventional fashion, includes an air compressor which supplies compressed air to a combustor assembly in which fuel is intermixed with the compressed air and ignited. The combustion products from the combustor assembly form the gas stream for the turbine engine and exhaust through a nozzle gas stream passageway 12 and then through one or more turbine stages.

Referring now to FIGS. 1 and 2, the inlet nozzle further comprises an inner annular shroud 14, an outer annular shroud 16 which is coaxial with the spaced radially outwardly from the shroud 14 and a plurality of circumferentially spaced nozzle vanes 18 extending therebetween. The shrouds 14 and 16 and the vanes 18 are of an integral construction and preferably comprise a single piece casting. In addition, each vane 18 is of a thin wall construction thus having an interior wall 20 which defines an interior chamber 22.

Figure 4:
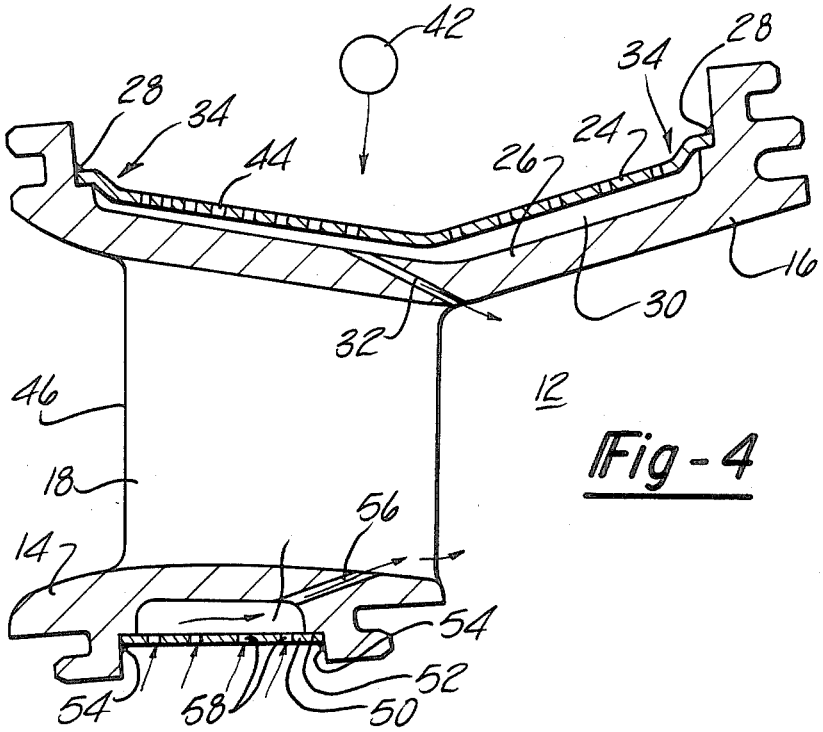
FIG. 4 is a sectional view of the turbine inlet nozzle and showing the cooling air flow therethrough.

With reference now to FIGS. 1-4, an outer thin walled impingement plate 24 is positioned over and around the outer periphery 26 of the outer shroud 16 so that the impingement plate 24 extends entirely across the nozzle vanes 18. Each axial end of the impingement plate 24 is fixedly secured to the outer periphery 26 by welds 28 so that each axial end of the impingement plate 24 is completely sealed to the outer shroud 16. Moreover, as is best shown in FIGS. 2 and 4, with the impingement plate 24 secured to the outer shroud 16 in the above-described fashion, at least a portion of the impingement plate 24 is spaced outwardly from the outer periphery 26 of the shroud 16 thus forming a chamber 30 therebetween. The chamber 30 is fluidly connected with the nozzle gas stream passageway 12 by a plurality by circumferentially spaced passageways 32 formed through the outer shroud 16.

With reference now particularly to FIGS. 3 and 4, each axial end of the impingement plate 24 is flared outwardly to form an S-shaped portion 34 having an outer leg 36, a central leg 38 and an inner leg 40. Only the outer leg 36 of each S-shaped portion 34 is secured to the outer shroud 16 by the welds 28. The purpose of the S-shaped portions 34 will be subsequently described in greater detail.

With reference now to FIG. 4, a cooling fluid source 42 (illustrated only diagrammatically) is fed to the outer periphery of the outer impingement plate 24. In addition, the outer impingement plate 24 includes a plurality of apertures 44 formed through it so that the compressed fluid from the source 42 flows through the apertures 44 into the chamber 30 and against the outer periphery 26 of the shroud 16 thus cooling the shroud 16. Thereafter, the fluid flows from the chamber 30 through the passageways 32 to the turbine gas stream and is exhausted from the turbine engine. In the preferred form of the invention, the source 42 is a small portion of the compressed air from the turbine compressor which is diverted from the combustor and bled to the outer periphery of the impingement plate 24.

Still referring to FIG. 4, the apertures 44 are arranged in density and/or hole size both axially along and circumferentially around the impingement plate 24 in accordance with the cooling requirements of the outer shroud 16. The shroud cooling requirements will, of course, vary with the combustor assembly characteristics and variation of the surface heating rate due to the pressure distribution of the flow situation along the nozzle surface. For example, as shown in FIG. 4 a plurality of closely spaced apertures 44 are formed along the impingement plate 24 near the leading edge 46 of the vane 18 while the apertures 44 are more widely spaced along the trailing edge of the vane 18.

With reference now to FIGS. 1 and 4, an inner annular impingement plate 50 is secured to the inner periphery 52 of the inner shroud 14. Like the outer impingement plate 24, the inner impingement plate 50 is secured along each of its axial ends to the inner shroud 14 by brazes or welds 54 so that the axial ends of the inner impingement plate 50 are completely sealed to the inner shroud 14. A chamber is also formed between the inner shroud 14 and inner impingement plate 50 and this chamber is fluidly connected with the gas stream passageway 12 via a plurality of circumferentially spaced passages 56 formed through inner shroud 14.

A plurality of apertures 58 are formed through the inner impingement plate 50 and a portion of the fluid from the source 42 is supplied to the inner periphery 52 of the inner impingement plate 50. This fluid flow then passes through the apertures 58, into the chamber and against the inner shroud 14 thus cooling it. This compressed air is then exhausted through the passages 56, into the air stream passageway 12 and exhausted from the turbine engine.

Figure 5:
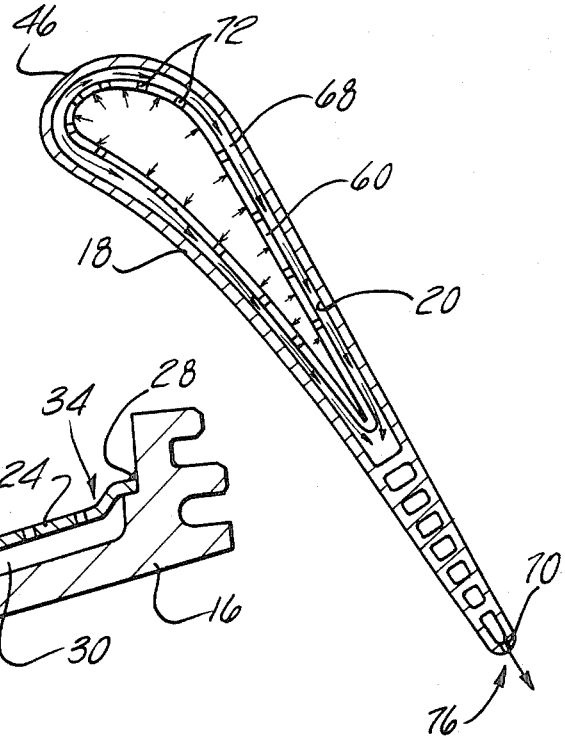
FIG. 5 is a cross-sectional view taken substantially along line 5—5 in FIG. 2 showing the cooling air flow through the nozzle vanes and enlarged for clarity.

Referring now particulary to FIGS. 1, 2 and 5, a tubular vane liner 60 having a closed bottom 62 is positioned through an aperture 64 in the outer impingement plate 24 for each vane 18 and into the interior chamber 22 of each vane 18. Each vane liner 60 includes an outwardly extending flange 66 about its upper end which abuts against the outer periphery of the outer impingement plate 24. The flange 66 of each liner 60 is secured to the impingement plate 24 by conventional means, such as welding.

As best shown in FIGS. 2 and 5, the vane liner 60 is of substantially the same shape but smaller in dimension than the interior walls 20 of the vane 18 thus forming a chamber 68 therebetween. This chamber 68 is open to the gas stream passageway 12 via one or more fluid ports 70 formed in the tail end of vane 18.

The vane liner 60 further includes a plurality of apertures 72 formed through it. During the operation of the turbine engine, fluid from the source 42, i.e., preferably compressed air from the compressor, enters through the open top of each vane liner 60 and passes through the holes 72, into the chamber 68 and thus against the interior wall 20 of the nozzle vanes 18 thereby cooling the nozzle vanes 18. This fluid is then exhausted through the port 70, into the engine gas stream and exhausted from the engine. In addition, the apertures 72 are formed through each vane liner 60 in hole density and/or hole size in accordance with the cooling requirements for the nozzle vane 18. Thus, as is shown in FIG. 5, the density of the aperture 72 in the vane liner 60 is greatest along the leading edge 46 of the nozzle vane 18 and decreases in density toward the trailing edge 76 of the vane 18.

In operation, the fluid from the source 42 is bled to both the outer periphery 26 of the outer impingement plate 24 and also to the inner periphery 52 of the inner impingement plate 50. This fluid then flows through the impingement plates 24 and 50 in the previously described fashion and thus cools both the outer and inner shrouds 16 and 14, respectively. This cooling fluid flow is thereafter exhausted into the engine gas stream and from the engine.

Simultaneously, a portion of the fluid from the source 42 flows into the interior of the vane liners 60, through the liner apertures 72 and against the vanes 18 thus cooling the vanes 18. Like the fluid flow to the impingement plates 24 and 50, the fluid flow into the interior of the vane liner 60 is eventually exhausted to the gas stream through the ports 70 at the trailing end of each vane 18.

With reference now particularly to FIG. 3, the outer impingement plate 24 remains relatively cool with rspect to the shroud 16 due to the cooling fluid flow continually flowing through the outer impingement plate 24. Thus, as the other shroud 16 reaches its normal elevated operating temperature, the shroud 16 undergoes greater thermal growth than the relatively cool impingement plate 24. The thermal growth of the shroud 16 is both in a radial and axial direction and is illustrated in FIG. 3 in phantom line and in exaggerated form.

Still referring to FIG. 3, as the thermal growth of the shroud 16 exceeds the thermal growth of the impingement plate 24, the S-shaped portion 34 of the impingement plate 24 becomes flattened as contrasted to its original shape, since the outer leg 36 of each S-shaped portion 34 is fixedly secured to the outer shroud 16. Since the S-shaped portions 34 merely distort to compensate for the differential thermal growth between the impingement plate 24 and outer shroud 16, the S-shaped portions 34 minimize the thermal stresses in the impingement plate 24 and completely eliminate the possibility of a stress rupture between the impingement plate 24 and the outer shroud 16. Moreover, when the turbine engine is cooled, the S-shaped portions 34 merely return to their original shape.

From the foregoing it can be seen that the present invention provides a novel impingement plate cooled turbine nozzle assembly which minimizes thermal stress and possible rupture between the impingement plate 24 and outer shroud 16 despite differential thermal growth. Moreover, the axial ends of the impingement plate 24 are completely sealed to the outer shroud 16 which eliminates the need for seals and likewise completely eliminates leakage around the edges of the impingement plate 24. Similarly, since the inner shroud 14, outer shroud 16 and nozzle vane 18 are integrally constructed, the previously known need for sealing the nozzle components together is also completely eliminated along with the leakage of coolant fluid.

A still further advantage of the turbine nozzle of the present invention is that the hole density and/or size in the impingement plates 24 and 50 are also in the vane liner 60 are arranged in accordance with the cooling requirements of the nozzle assembly. By this construction, thermal gradients across the nozzle components are minimized thus minimizing thermal stresses within the vane and the possibility of thermal distortion of the vane geometry.

Having described our invention, however, many modifications thereto will become apparent to those skilled in the art to which it pertains without deviation from the spirit of the invention as defined by the scope of the appended claims.

We claim:

1. For use in a turbine engine, a turbine nozzle assembly comprising:

a housing, said housing having an annular outer shroud having an inlet axial end and an outlet axial end, and a plurality of vanes extending radially inwardly from said outer shroud between its axial ends, said vanes being circumferentially spaced from each other and disposed in a turbine gas stream, a tubular and cylindrical impingement plate positioned coaxially around the outer shroud so that at least a portion of the plate is spaced radially outwardly from said outer shroud thus forming a chamber therebetween, said plate having a plurality of apertures formed through it, means for sealingly and fixedly attaching one axial end of the impingement plate to the inlet end of said outer shroud and for sealingly and fixedly attaching the other axial end of the impingement plate to the outlet end of said outer shroud, fluid passage means formed between said chamber and the turbine gas stream, means for communicating a pressurized cooling fluid to the outer periphery of the outer shroud, and wherein said impingement plate includes means intermediate its ends for permitting axial differential thermal growth between said impingement plate and said outer shroud while minimizing thermal stress between said impingement plate and said outer shroud.

2. The invention as defined in claim 1 wherein said housing is of integral construction.

3. The invention as defined in claim 1 wherein each vane has a hollow interior which is open through said outer shroud, said nozzle assembly further comprising a plurality of tubular liners, each liner being open at one end and closed at its other end, each liner being positioned through an opening in the impingement plate and into the interior of one vane so that each liner is spaced inwardly from an interior wall of the vane thus forming an annular chamber therebetween, each liner including a plurality of apertures formed through it, and further fluid passage means for fluidly connecting said annular chamber and said turbine gas stream.

4. The invention as defined in claim 3 and further comprising means for sealingly and fixedly securing said open end of the liner to said impingement plate.

5. The invention as defined in claim 1 wherein said means for attaching said impingement plate to said housing comprises a welded attachment of said impingement plate to said housing.

6. The invention as defined in claim 1 wherein said means for permitting differential thermal expansion further comprises a radially outwardly flared portion adjacent each end of the impingement plate, wherein each outwardly flared portion has an outer leg and a central leg, wherein only the outer leg of each outwardly flared portion of the impingement plate is attached to the housing.

7. The invention as defined in claim 1 wherein said housing further comprises an inner shroud spaced radially inwardly from and coaxial with said outer shroud so that said vanes extend between said shrouds and wherein said housing is of integral construction.

8. The invention as defined in claim 1 wherein the density of said apertures through said impingement plate increases in accordance with the amount of heat to which the adjacent portions of the shroud are subjected.

9. The invention as defined in claim 1 wherein the size of said apertures through said impingement plate increases in accordance with the amount of heat to which the adjacent portions of the shroud are subjected.

* * * * *